US005238432A

United States Patent [19]

Renner

[11] Patent Number: 5,238,432

[45] Date of Patent: Aug. 24, 1993

[54] MARINE DRIVE UNIT IMPACT AVOIDANCE SYSTEM

[76] Inventor: Howard E. Renner, 16464 SW. Wilsonville Rd., Wilsonville, Oreg. 97070

[21] Appl. No.: 780,086

[22] Filed: Oct. 17, 1991

[51] Int. Cl.[5] ..... B63H 5/12

[52] U.S. Cl. ..... 440/56; 440/1; 440/65

[58] Field of Search ..... 441/1, 2, 61, 63, 65, 441/900, 113, 56, 55

[56] References Cited

U.S. PATENT DOCUMENTS

| | | | |
|---|---|---|---|
| 1,473,832 | 11/1923 | Park | 440/65 |
| 1,780,552 | 11/1930 | Coggins et al. | 440/65 |
| 1,840,949 | 1/1932 | Harvey | 440/65 |
| 2,135,907 | 11/1938 | Miller | 440/65 |
| 4,757,971 | 7/1988 | Mapes | 440/1 |

*Primary Examiner*—Joseph F. Peters, Jr.

*Assistant Examiner*—Stephen P. Avila

*Attorney, Agent, or Firm*—Olson & Olson

[57] ABSTRACT

A marine drive unit impact avoidance system for boats having both outboard type drives and inboard/outboard type stern drives provides a structure by which the lower, propeller-mounting drive unit on a boat is mounted for vertical movement relative to the supporting transom of a boat, and an impact/activating arm assembly is pivotally mounted at one of its ends to the lowermost forward portion of the lower unit for upwardly angled, forward extension therefrom to a pivotal mount at its other end to the boat, whereby any underwater obstruction encountered during forward movement of the boat will contact only the impact arm which operates under the impact to effect a cam action to lift the drive unit vertically to clear the obstruction without any contact of the drive unit and the underwater obstruction.

16 Claims, 8 Drawing Sheets

MARINE DRIVE UNIT IMPACT AVOIDANCE SYSTEM

BACKGROUND OF THE ART

This invention relates to marine drive units for boats, specifically of both the outboard type and the inboard-outboard type, and more particularly to the safety mechanisms which permit and provide their movement particularly when the drive unit encounters an underwater obstacle during movement of the boat through the water.

Heretofore in the art, the only provision for limiting potential damage experienced by outboard and inboard-outboard type drive units during operation have been variations on locking safety tilt mechanisms that permit the drive unit to tilt arcuately about their mount on the transom of a boat when the impact against the lower portions of the drive unit is sufficient to overcome the forward thrust produced by the drive unit during operation. In all cases however, the impact required to operate the safety systems of the prior art require that the drive unit itself must collide with an obstacle directly and receive the impact of that collision in order for the drive unit to be caused to tilt.

As any boat operator knows, marine drive units are expensive pieces of equipment, and it is highly disadvantageous for them to be struck at all, and often such impacts result in varying degrees of damage to the lower unit, the tower housing, the propeller, internal drive components and safety release mechanisms of these units, and even to the transoms of the boats themselves in severe impact situations, as in fast travelling boats.

Moreover, locks have to be provided to prevent tilting of the drive units when they are being used in reverse, else propeller thrust simply tilts them into non-functional positions. Also, in the case of inboard/outboard type outdrives, steep tilting of the unit when the engine is running results in serious damage to the U-joint drives and the gear drives. Internal damage is frequently consequent of tilting during an impact or when a boat owner runs his outdrive in tilted condition in shallow waters.

Illustrative of conventional safety tilt mechanisms of the prior art are U.S. Pat. Nos. 3,470,844; 3.570 443; 3,577,954; 3,648,645; 3,722,456; 3,859,952; and 3,952,687. U.S. Pat. No. 3,469,558 discloses an extremely complex, combination boat hull and motor/-drive shaft pivot mount arrangement designed to protect the propeller of an inboard-powered boat from damage during an impact. U.S. Pat. Nos. 3,807,347; 3,980,039 and 4,089,290 disclose basic mounts for movement of the drive units vertically between operative and inoperative positions on a boat. Nowhere however has the industry sought to avoid actual damaging contact of the outdrive units with an obstacle in order to operate safety mechanism which will automatically remove the drive unit from the potential of injury during operation. In all instances, the operation of the drive unit protection systems are activated and operated solely by virtue of the impact of the expensive drive unit with an underwater obstacle.

SUMMARY OF THE INVENTION

In its basic concept, this invention provides a marine drive unit mount and support structure configured to carry a marine drive unit for movement of the latter vertically, and impact sensing and activating structure engaging the drive unit to move the drive unit vertically relative to the transom of the boat so that the lower unit of the marine drive unit clears an underwater obstacle without any contact of the drive unit itself with the underwater obstacle.

It is by virtue of the foregoing basic concept that the principal objective of this invention is achieved; namely, the provision of a marine drive unit impact avoidance system which completely avoids the heretofore essential damaging contact of a marine drive unit with an obstacle in order to effect movement of the drive unit into a position which clears the underwater obstacle.

Another object of this invention is the provision of a marine drive unit impact avoidance system of the class described which utilizes a mechanical impact/activator arm assembly pivotally mounted to the bottom of the drive unit and extending forwardly to a pivotal mount on the boat, whereby any underwater obstruction encountered during operation of the boat will contact only the impact arm which operates under an impact to effect a cam action to lift the drive unit vertically on its mount to clear the obstacle without any contact of the drive unit itself with the underwater obstacle.

Another object of this invention is the provision of a marine drive unit impact avoidance system of the class described in which the mechanical impact/activator structure just described may alternatively utilize a sonar-type sensor arranged to sense the presence of an underwater obstacle and activate a circuit which activates a hydraulic lift cylinder on the drive unit to lift the latter vertically on its mount to clear the underwater obstacle without any contact of the drive unit with the obstacle.

Another object of this invention is the provision of a marine drive unit impact avoidance system which permits a full range of trim control.

Another object of this invention is the provision of a marine drive unit impact avoidance system of the class described which permits adjustment of the desired running depth of the drive unit for shallow and deep waters without affecting the desired trim or propeller thrust angle of the drive unit, and without adversely affecting the operation of the drive unit.

A further object of this invention is the provision of a marine drive unit impact avoidance system of the class described which accommodates both outboard type drive units and inboard/outboard type drive units.

A further object of this invention is the provision of a marine drive unit impact avoidance system of the class described which enhances trailerability and weight distribution of a trailered boat by raising the drive unit vertically close into the transom of a boat rather than the heretofore necessary arcuate tilting of the drive unit which results in the heretofore common disadvantage of the drive unit projecting rearwardly from the boat a distance of up to 3 feet, typical of conventional tilt arrangements.

A still further object and advantage of this invention is the provision of a marine drive unit impact avoidance system which completely eliminates contact of the drive unit with an underwater obstacle during operation of a boat, and thereby eliminates the significant expenses involved in repairs resulting from even minor impacts which have been required heretofore in the art in order to allow the safety mechanisms associated with marine drive units to operate.

The foregoing and other objects and advantages of this invention will appear from the following detailed description take in connection with the accompanying drawings of preferred embodiments.

DESCRIPTION OF THE PREFERRED EMBODIMENTS

Figure 1:
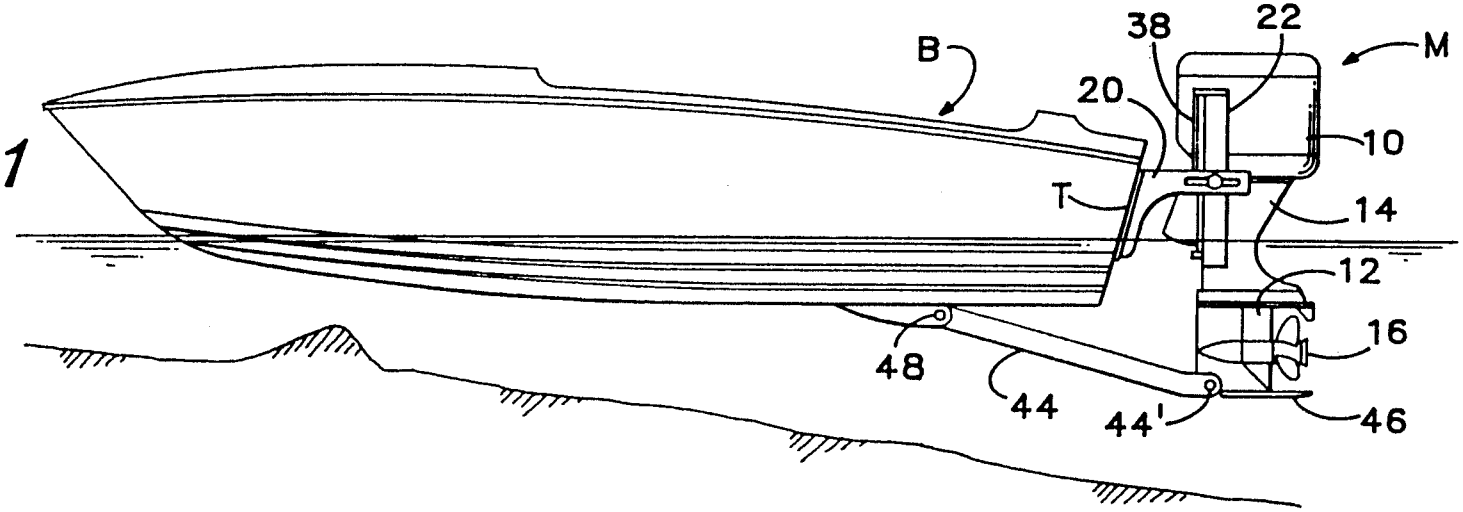
FIG. 1 is a side elevation of a boat having a conventional outboard motor carried by a marine drive unit impact avoidance system embodying the features of this invention, the unit shown in fully lowered, operative condition.

The marine drive unit impact avoidance system of this invention is illustrated herein in different embodiments to demonstrate its versatility in accommodating a wide variety of marine drive systems. In this manner, the common basic structures, goals and operations of the invention is also readily seen, and the distinguishing features of the present invention over the tilt systems heretofore provided become clearly apparent to those skilled in the art. It will also be understood by those skilled in the art that, while the embodiments shown are workable, preferred structures, they are illustrated in simplified form so as not to confuse or detract from the important basic structures necessary to the successful operation of this invention. Those knowledgeable in the art will readily recognize that various changes and modifications are anticipated for these and other uses.

Referring to the first embodiment of the impact avoidance system of this invention, shown in FIGS. 1–5, there is illustrated a typical boat B, having a transom portion T, and a conventional outboard motor M. As is typical in these outboard motor constructions, the motor is a single unit having an upper power head 10, a lower drive unit 12, an interconnecting tower portion 14, and a propeller 16. These motors typically include a conventional transom clamp structure 18 configured to mount the outboard to the transom T of a boat.

With it understood that the boat B and motor M of FIGS. 1–5 are conventional items, it becomes clear that the invention, as embodied in FIGS. 1–5, provides a marine drive unit impact avoidance system arranged and configured to operate in conjunction with already available, standard marine drive units and boats. This is particularly advantageous in the aftermarket upgrading of boat owner's existing equipment.

Means is provided to mount an outboard in position on the back of a boat. In this embodiment, the outboard mounting means comprises a pair of transom mounting members, 20 configured for attachment to the transom of a boat in any suitable, conventional manner such as by bolts (not shown). It will be understood however that alternatively the two separate transom mounting members 20 shown, may be mounted on a base plate (not shown), the base plate being provided with suitable clamps (not shown) configured for releasable engagement with the transom similar to a typical outboard motor mount 18 conventional in the art.

As shown, the rearwardly projecting transom mounting members 20 each are configured to carry a vertically extending slide bracket 22. In this embodiment each slide bracket mounts projecting lugs 24 configured to be slidably received within longitudinally extending channels 26 provided in the mounting members 20 for positional adjustment of the slide brackets 22 along the length of the transom mounting arm members 20. Means to secure the vertically extending brackets in the desired position along the transom mounting members may be provided in any suitable manner such as the friction clamp bolt 28 assembly shown, or alternatively by hydraulic piston cylinders 29 interconnecting the slide brackets and the transom as shown on the other side, if powered adjustment is desired.

The vertically extending slide brackets 22 are each configured to receive cooperating slide members 30 mounted on the outer terminal ends 32' of a substantially U-shaped motor mount bracket 32 spanning the distance between the projecting transom mounting members 20. The motor mount bracket is configured to be engaged by the conventional mounting clamp structure 34 of an outboard motor. Thus it is seen that the aforementioned outboard mounting structure is configured as a vertically movable, motor-mounting carriage for vertical travel along the length of the vertically extending slide brackets 22.

In the embodiment illustrated, the upper end of each slide bracket includes a support bracket configured to mount one end of a drive-unit-raising hydraulic cylinder 36 and a shock absorber 38, each of which are connected at their opposite ends to a bracket 40 extending from the slide members 30 slidably captured within the vertical slide bracket 22. The shock absorber 38 is preferably double acting, and positively secured to the bracket 40 so that both upward and downward movement of the bracket 40 (and associated motor mount carriage 32) is dampened by the shock absorber in both directions of travel. It is desirable however that the bracket 40 be permitted free upward movement with respect to the hydraulic lift cylinder 36. In this regard the piston 36' of the cylinder extends freely through an enlarged bore through the bracket 40 and a enlarged end fitting 42 is secured to the terminal end of the piston so that the bracket 40 may move freely upward along the extended piston, and yet the end fitting 42 will engage the bracket positively to raise the motor mount assembly when the hydraulic cylinder is operated to retract its piston upwards. The purpose of this construction will become apparent in the description of the operation of the present embodiment.

An important feature of the impact avoidance system of this invention is the provision of collision sensing and activating means configured to respond to the presence of an underwater obstacle and operate to lift the drive unit vertically so that the lower unit of the drive unit clears the obstacle before the latter contacts the drive unit. In the first four embodiments of this invention, this sensing and activating means is provided by an impact arm member 44 now to be described.

As seen in the drawings, the impact arm 44 is a longitudinally elongated, preferably substantial member having a rear end 44' configured for universally pivotal mount to the base of an drive unit. For simplicity of illustration, the lower unit of the drive unit in the drawings is shown as specially configured to mount the arm member, but it is to be understood that the lower unit ma alternatively be conventional in configuration and provided with a suitable arm-mounting bracket arranged for releasable or permanent attachment to the drive unit. It is desirable that a skid plate 46 be provided on the base of the lower unit to extend beneath the propeller to protect the latter during movement of the boat over an obstruction. The skid plate can be integral with the lower unit casting, as shown, part of the aforementioned alternative arm-mounting bracket assembly, or separately provided and attachable as is presently known in the marketplace.

The impact arm is configured and dimensioned in this embodiment to extend forwardly from the drive unit and angularly upward to the base of the hull, where it is attached to the latter by a pivot mount 48. While the particular angle of the impact arm resulting from the particular distance between its mounts at its opposite ends is not particularly critical to its successful operation, it will be understood that the steeper the resulting angle, the more sudden and violent the lifting action will be upon impact. Additionally, a longer impact arm, and correspondingly shallower angle, will result in only a negligible degree of arcuate movement of the rear end of the arm in the relatively short upward travel of that end of the arm between fully lowered and fully raised conditions. Thus, the system illustrated does not need to accommodate for tilting of the outboard during raising and lowering operations.

Figure 3:
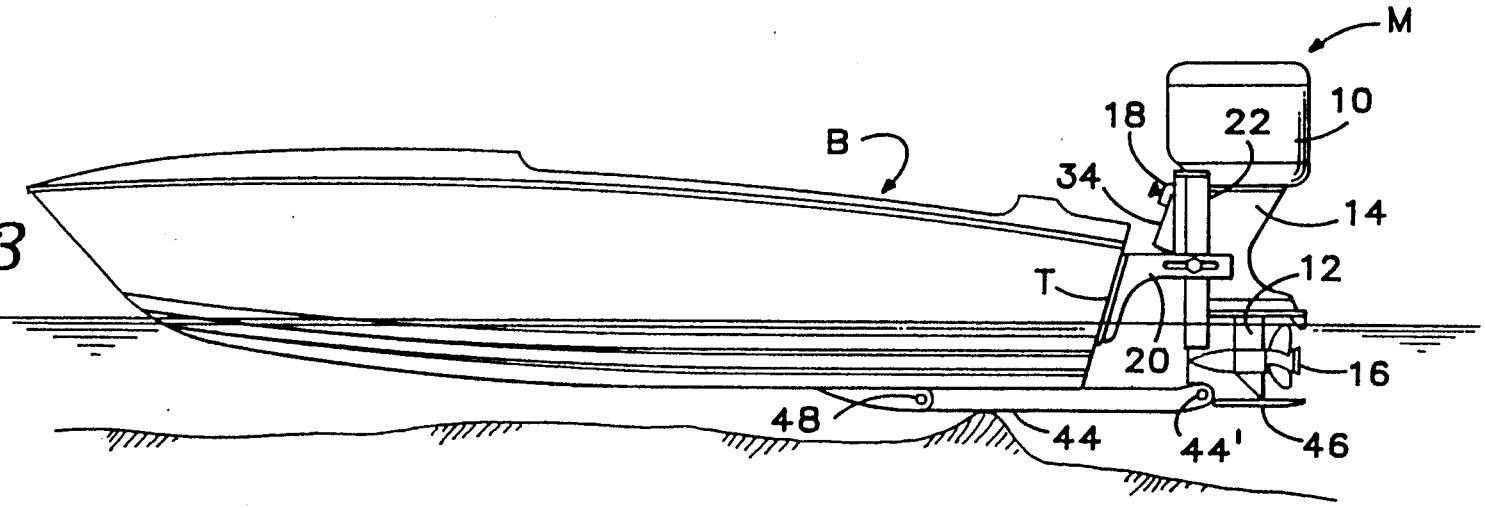
FIG. 3 is a side elevation of the boat and motor of FIG. 1 after having contacted an underwater obstruction and the impact avoidance system having operated to raise the outboard into condition which avoids the obstacle.
Figure 5:
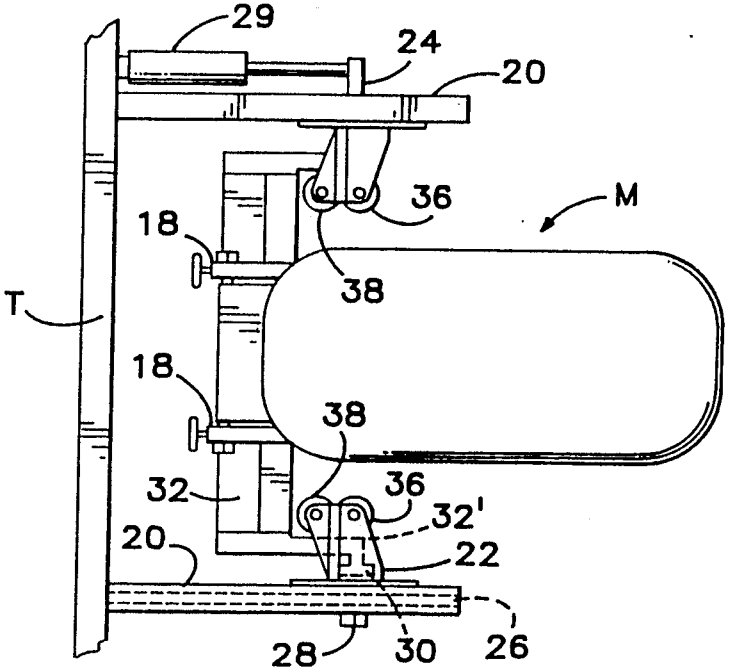
FIG. 5 is a fragmentary plan view of the impact avoidance system shown in FIGS. 1–4, as viewed from the top in FIGS. 1–4.
Figure 2:
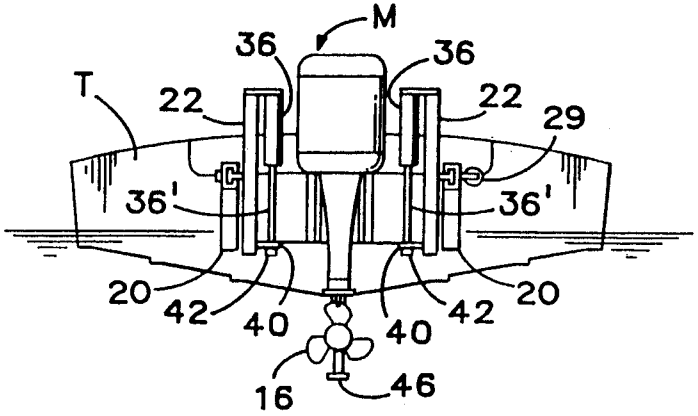
FIG. 2 is a rear elevation of the rear of the boat shown in FIG. 1 as seen from the left in FIG. 1.
Figure 4:
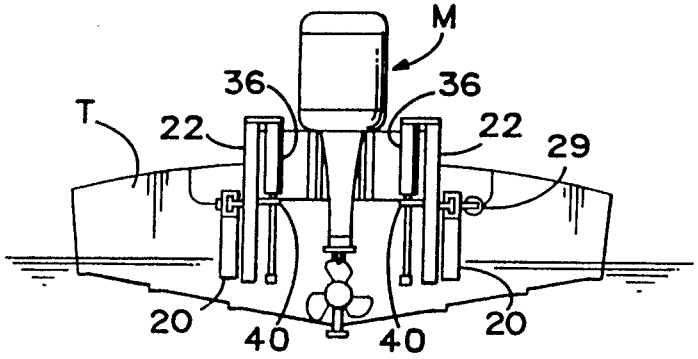
FIG. 4 is a rear elevation of the rear of the boat shown in FIG. 3, as seen from the left in FIG. 3.

The impact avoidance operation of the system just described is virtually self-explanatory in viewing FIGS. 1 and 3 of the drawings. Upon approaching and contacting an underwater obstacle extending in front of the drive unit of a boat, the arm is pivoted upwardly about its forward pivot mount 48 to whatever degree is required to clear the obstacle as the boat progresses forward. As the arm pivots upwardly it lifts the drive unit connected to its rear end vertically upward on the motor mounting carriage assembly mounted on the transom of the boat. The shock absorbers 38 dampen the action of the carriage as required.

For trailering and shallow water operation, the hydraulic cylinders 36 ma be operated to retract their pistons and raise the drive unit vertically to any desired degree, and it will be noted that such height adjustment does not affect the trim or propeller thrust angle heretofore inevitable with conventional tilt systems that must tilt the outboard angularly rearward to accommodate shallow waters.

Desired variations in trim and thrust angle may be accomplished by activating hydraulic trim cylinders 29 to move the carriage assembly forward or rearward along the transom mount brackets 20, thereby tilting the outboard motor relative to vertical on its universal pivot mount 44, on the impact arm located at the base of the lower unit.

Figure 6:
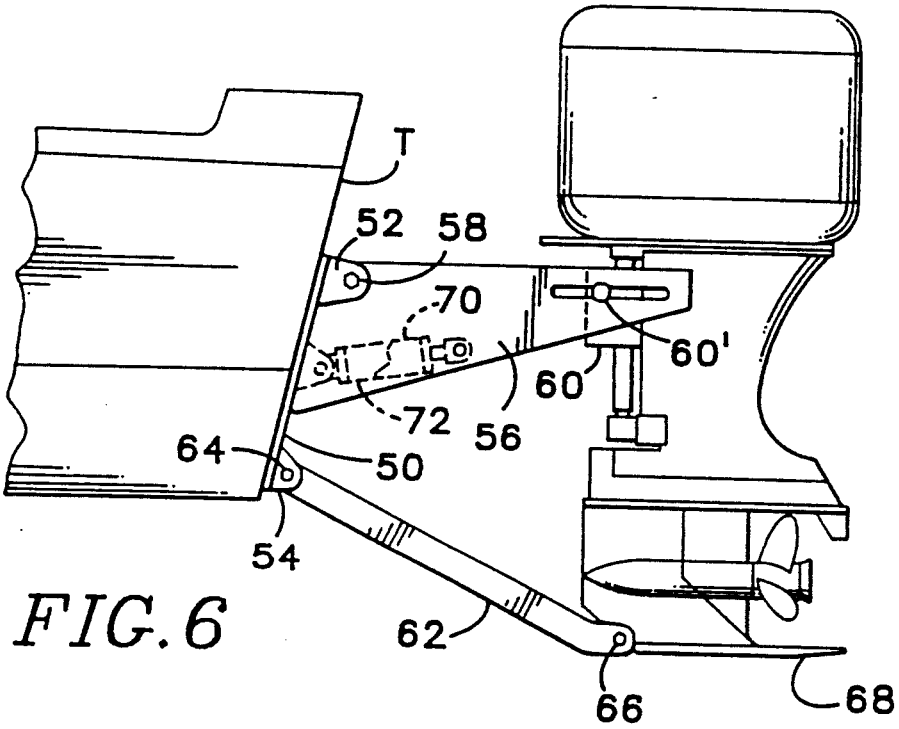
FIGS. 6 and 6*a* are fragmentary side elevations of another embodiment of the impact avoidance system of this invention for use with a conventional outboard motor, configured for mounting entirely on the transom of a boat.
Figure 6A:
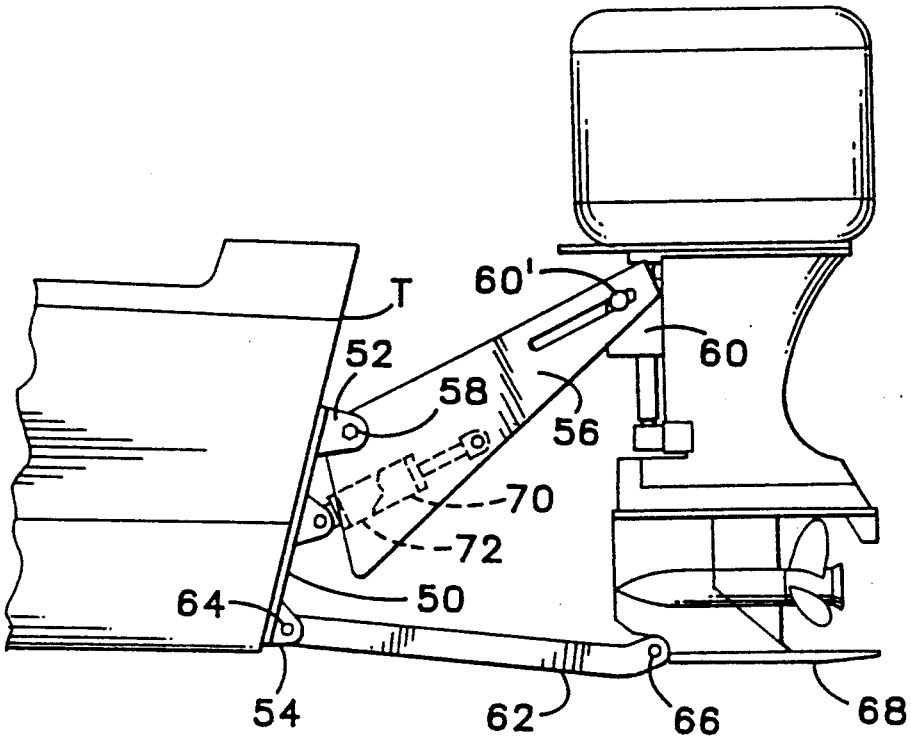

The marine drive unit impact avoidance system for outboard motors may also be provided for simplified mounting to boats without the need of below water line intrusion of the hull of the boat. The embodiment of FIG. 6 illustrates the transom of a boat mounting a base member 50 having spaced apart upper pivot mounts 52 and lower, center pivot mount 54 thereon. The upper pivot mounts 52 receive projecting support arm members 56 secured pivotally thereto by pins or pivot bolts 58. The projecting arm members 56, like the transom mounting members 20 described earlier, mount a motor-mounting carriage 60 for positional adjustment along the length of the arm members for trim control, similar to the previously described embodiment. However, as shown, in this embodiment the carriage 60 is not provided vertical movement relative to the arm members, but rather the carriage is mounted to the arm members for pivotal movement on an axis 60' extending between the arm members but is substantially parallel to the axis of the arm members' pivot mount 52 on the transom base member 50. The purpose of this construction will appear later in the description of the operation of the embodiment.

The lower pivot mount 54 on the base member 50 pivotally receives the forward end of an impact arm 62 as by pin or bolt 64. The arm extends angularly downward and rearward to the base of the lower unit of the outboard motor, where it is connected by universal pivot couplers 66 as described earlier. A propeller protecting skid plate 68 may be provided as also described earlier.

Upon encountering a submerged obstacle as the boat progresses forwardly, the impact arm 62 is moved upwardly about its forward pivot mount 64, lifting the outboard vertically and causing the rearwardly projecting support arm members 56 to pivot about their mounts 58 on the base member 50. By virtue of the rotationally pivotal mount of the motor-mounting carriage 60 on the arm members, the arm members are permitted upward movement while the outboard remains substantially vertical on its mounts of the carriage and at the base of the lower unit connected to the impact arm.

Shock absorbers 70 are preferably provided interconnecting the arm members 56 and the base member 50 to dampen their movement in both directions, and hydraulic lift cylinders 72 may also be similarly provided between the base member and the arm members to move the latter about their pivots 58 to raise and lower the outboard to desired levels. Also, just as described in the earlier embodiment, hydraulic trim-adjust cylinders 29 interengaging the transom mounting member 50 and the carriage mount on the arm members may be provided to position the carriage along the arm members for trim adjustment and propeller thrust angle adjustment in the same manner as has been previously described.

Figure 8:
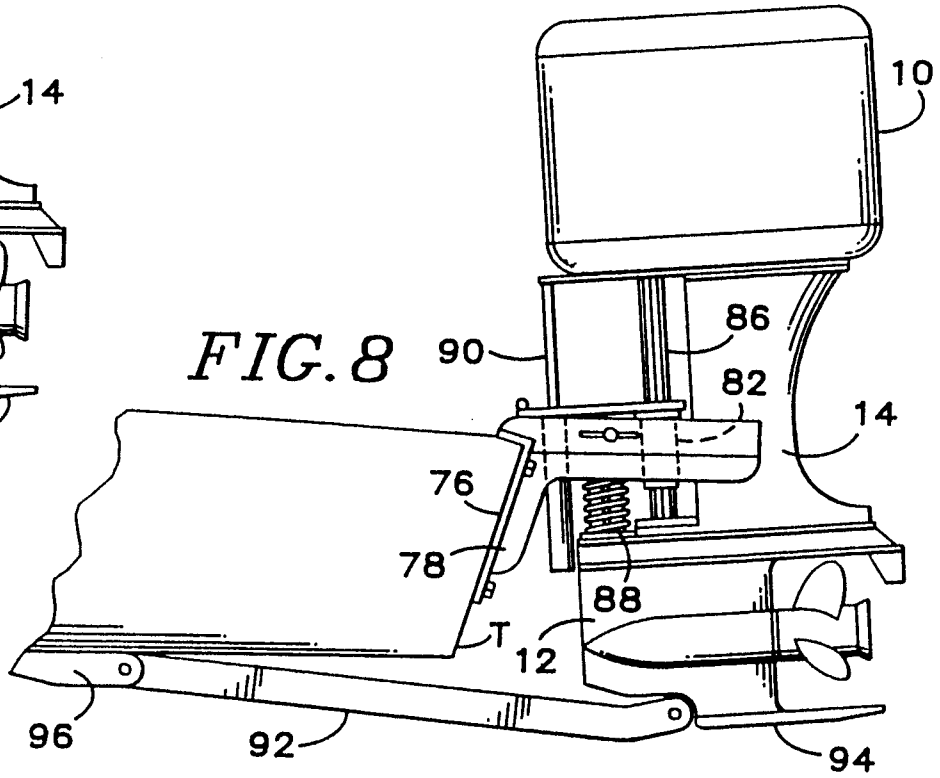
FIGS. 7 and 8 are fragmentary side elevations of the marine drive unit impact avoidance system of this invention utilizing a specially configured outboard motor/drive unit configuration to illustrate the versatility of this invention and emphasis the basic concept involved in this invention, FIG. 7 showing the drive unit in lowered, operating condition and FIG. 8 showing the drive unit in raised condition as the result of the contact of the impact arm with an underwater obstruction.
Figure 7:
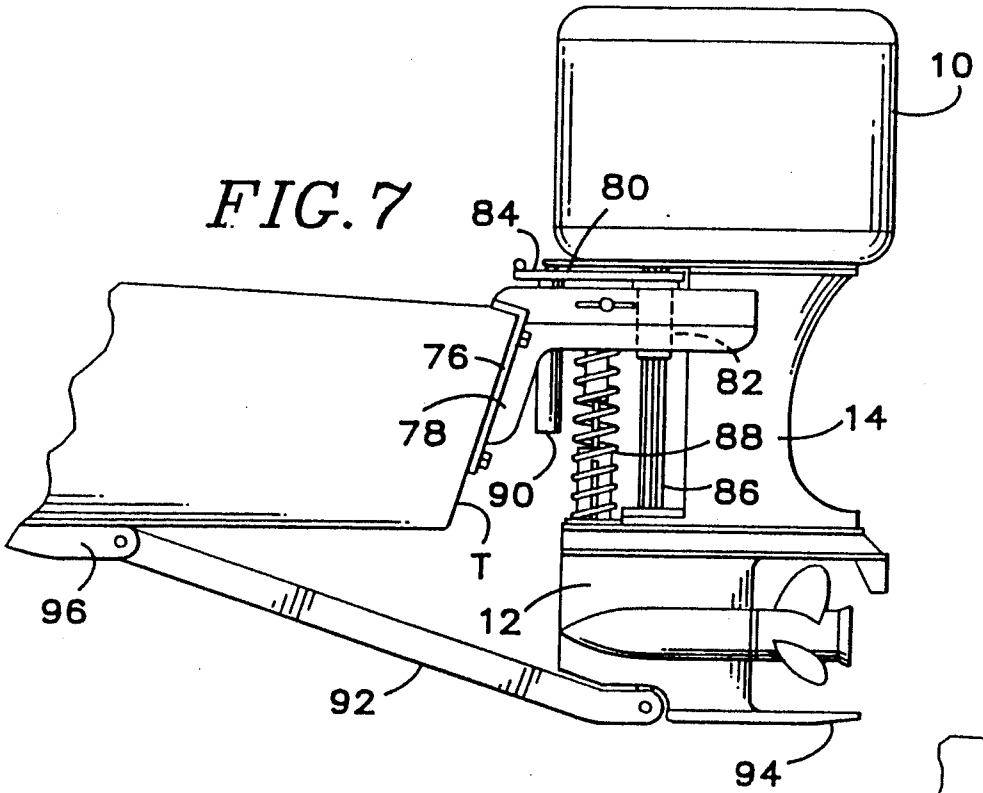

The foregoing embodiments of the marine drive unit impact avoidance system of this invention provide examples of structures which accommodate conventional outboard type motors as an after market upgrade. A production outboard utilizing the features of this invention is illustrated in FIGS. 7 and 8 wherein the outboard motor and the impact avoidance system are integrally related in order to reduce the cost and weight of the system when installed as original equipment or as a full re-fit of the power system of a boat.

In this embodiment, a transom mount assembly includes a base member 76 fixedly mounting projecting arm members 78 which receive a motor-mounting bracket 80 between them. This bracket is configured to be carried by the arm members for adjustable movement along the length of the arm members as described hereinbefore for trim adjustment. The motor-mount bracket 80 is configured to rotatably support and carry a steering assembly configured in this embodiment as a vertically disposed, hollow sleeve 82 having a forwardly extending steering arm 84 secured thereto and configured for attachment to the steering system of a boat. The inner surface of the hollow sleeve is configured with splines (not shown) arranged to cooperate with a splined mounting shaft 86 secured on the forward portion of the tower housing 14 and extending between the power head 10 and the lower unit 12. In this manner, the splined shaft 86 is able to move freely vertically within the stationary sleeve while always remaining in positive engagement with the cooperating splines, thereby maintaining positive steering control irrespective of the particular vertical disposition of the shaft within the sleeve and hence the vertical disposition of the outboard itself. With the motor thus supported on the boat, operation of the steering system of the boat to move the steering arm in one direction or the other rotates the sleeve in one direction or the other, and by virtue of the positive, splined connection between the sleeve and the shaft, the motor rotates in one direction or the other about the axis of the sleeve.

Preferably, a shock absorber 88 is provided between the rotating portion of the motor mount bracket 80 and the lower unit to dampen the upward and downward vertical movement of the latter during and after an impact. The hydraulic lift cylinder 90 is provided o the motor mount assembly to engage the outboard to raise the latter to desired elevations.

Being an integral, production system, the lower unit would preferably be specially configured to accommodate the universal connection of the impact arm 92 and the propeller skid plate 94 shown. The forward end of the impact arm member 92 is pivotally mounted to the bottom hull of the boat by bracket 96 as described earlier in connection with the embodiment of FIG. 1.

Contact of the impact arm with an underwater obstacle pivots the arm upwardly on its forward mount 96, lifting the outboard upwardly on its sliding connection of the splined shaft within the splined sleeve against the action of the shock absorber 88, which also serves to dampen the downward movement of the outdrive when it returns by gravity after the obstacle has been cleared. The tower housing between the power head and the lower unit may be provided with a protective boot (not shown) to protect the splined shaft and shock absorber assembly from the deleterious effects of the water.

The next embodiment of this invention is illustrated in FIGS. 9–12 and shows the marine drive unit impact avoidance system of this invention in connection with an inboard/outboard powered boat. It is particularly noteworthy to understand that the application of the impact avoidance system of this invention to inboard/-outboard drive units (hereinafter referred to as stern drives) provides a distinct and valuable advantage that has heretofore never been possible with conventional stern drives. Stern drives have never been intended for shallow water uses, and although they can tolerate a mild degree of tilt during operation, owners are expressly warned not to operate their outdrives in positions exceeding mere normal trim conditions. The damage resulting from contorted U-joint drives and improperly meshing drive gears by too-steeply tilted conventional outdrives is a most frequent and often most expensive routine repair seen in repair shops, and is a liability that has plagued stern drive boat owners throughout their history of use. The system of this invention completely eliminates that liability in stern drives.

Referring first to the drawings, as shown, a simplified drive unit-mounting transom assembly is illustrated, similar in construction to those described in earlier embodiments. It is to be understood however that other, more conventional upper unit-to-engine and transom steering mounts such as conventional gimble mounts could as well be provided as a more desirable alternative, but in order not to detract from the more important, basic features of this invention, the simplified mount shown in the drawings is considered satisfactory for the purpose of illustration.

As shown, the transom mounts a pair of spaced apart, rearwardly projecting support arm members 98 configured to support the upper unit 100 of the drive unit for positional adjustment of the latter along the length of the arm members for trim control as described in earlier embodiments. Hydraulic cylinders (not shown) may be provided as described earlier to interconnect the upper drive unit and the transom to move the former along its mount on the arm members as previously described for powered trim adjustment.

The upper unit 100 mounts a lower unit 102 for movement of the lower unit vertically toward and away from its upper unit. In the simplified embodiment illustrated, means interconnecting the upper and lower units for the aforementioned movement is illustrated herein as hinged control brackets 104 which maintain the units positively in aligned condition while also permitting their relative vertical movement. Other suitable guiding interconnecting means may alternatively be utilized, but this illustrates purpose. Interconnecting exhaust and cooling water hoses (not shown) may also be provided between the units as desired, or they may alternatively be provided through the hull of the boat 106.

In the simplified embodiment illustrated, the upper and lower units 100, 102 are connected together by a splined drive shaft 108 which engages the propeller 110 in a constant contact through conventional gearing in the lower unit. The upper unit includes transmission means which engages the drive shaft from the engine and permits suitable forward-neutral-reverse shifting as required, and also permits vertical movement of the drive shaft 108 throughout the vertical range of movement permitted the lower unit relative to the upper unit.

In this simplified form, a hollow, internally splined sleeve 112 mounts forward and reverse gears 114, 116 on its outer surface as shown, and is retained in the transmission for vertical movement sufficient to engage a corresponding drive gear 118 driven by the engine of the boat. Mechanical shift means (not shown) engages the sleeve 112 to move it between positions in which the forward gear 114, the reverse gear 116 or neither gear (neutral) is engaged by the drive gear 118.

The splined drive shaft 108 is received and carried within the mating splined sleeve 112 as shown, the drive shaft thereby positively engaged for rotation with the sleeve when it is engaged with the drive gear 118, but the drive shaft also being permitted vertical movement within the sleeve while always remaining engaged by the latter for rotation. In this basic manner, the lower unit and the drive shaft 108 may move vertically while always in operable engagement with the driving transmission. Sufficient open space is provided in the upper housing of the upper unit to permit extension of the drive shaft thereinto during its upward movement with the lower unit. A tension spring 120 may be provided between the upper and lower units to constantly urge the lower unit toward its downwardly extended condition, and for safety, a flexible, protective boot 122 may be provided to house the drive shaft and spring.

Shock absorber 124 is provided between the upper and lower drive unit to dampen the violent upward movement of the lower unit under impact, and hydraulic lift cylinder 126 may be provided to raise and lower the unit vertically as desired. The shock absorber and lift cylinder may be included within the protective boot if desired.

The impact avoidance system of this embodiment also includes an impact arm member 128 similar in construction and operation to those described in connection with earlier embodiments of this invention. The forward end of the arm 128 is pivotally mounted to the hull of the boat by pivot bracket 130, and universally pivotally mounted to the forward, lowermost end of the lower drive unit by universal pivot mount 132. A propeller skid plate 134 may also be provided, as described earlier, to protect the propeller from damaging contact with an underwater obstruction.

The operation of the stern drive impact avoidance system of this invention is obvious in view of the earlier descriptions in connection with the other embodiments. The arm 128, upon contact with an underwater obstruction, is compelled to pivot on the bracket 130, thereby lifting the lower unit 102 of the stern drive vertically, the drive shaft moving vertically within the splined sleeve 112 while the drive shaft and sleeve remain engaged in driving contact with each other and with the engine through the transmission means.

The shock absorber 124 between the upper and lower units dampens the upward and subsequent downward movement of the lower unit after the underwater obstruction has been cleared.

The unique stern drive construction embodied in this invention enjoys a novel and very advantageous benefit over stern drive constructions of the prior art in addition to its impact avoidance features. Specifically, since the lower unit is movable vertically by hydraulic cylinders 126 to any infinite number of positions between its fully lowered and fully raised positions without affecting the angular orientation of the upper unit relative to the drive line from the engine, as is heretofore required in conventional tilt systems incorporated in standard stern drive units, the running depth of the propeller is fully adjustable for shallow water conditions without any damage or even increased stress or resulting vibration on the running gear of the stern drive. Moreover, the adjustment of the vertical disposition (depth) of the lower unit does not affect the preset or desired trim or propeller thrust angle at all during operation of the boat in shallow or potentially precarious waters, since the movement of the lower unit is completely independent of the trim adjustment as discussed previously. These are extremely advantageous and desirable features to a boat operator.

Figure 12:
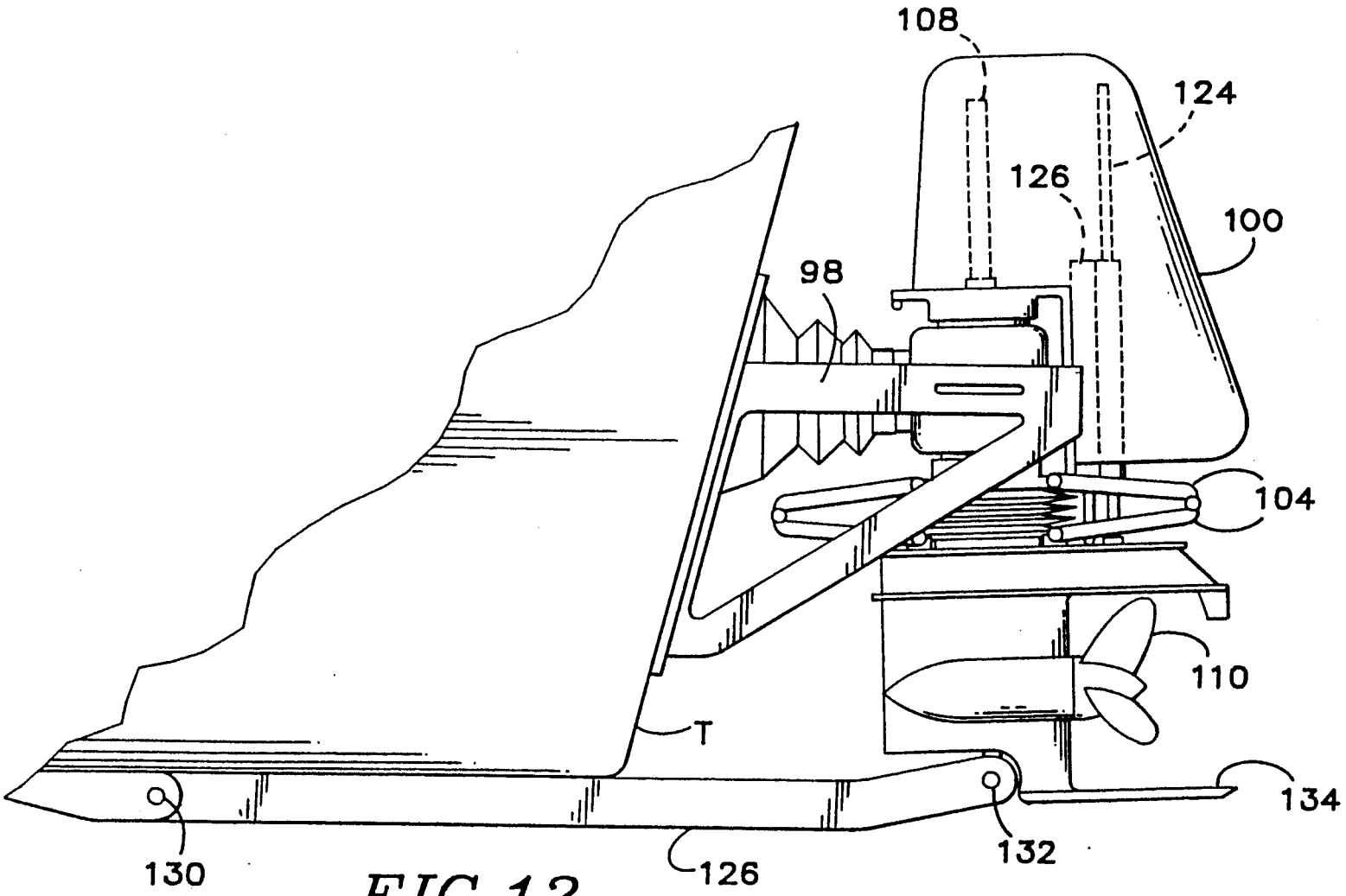
FIG. 12 is a fragmentary side elevation of the system shown in FIG. 11 in closer detail.

Additionally, for trailering the lower unit may be raised to its fully elevated condition of FIG. 12 in which its lowermost portions are disposed above the keel of the boat, as only a few tilt-type stern drives heretofore in the art are able to do. And as seen, the stern drive of this invention avoids the necessarily long overhang of conventional stern drives which are simply tilted upwardly and rearwardly in order to raise the lower unit a safe distance above a road surface during trailering.

In the foregoing description of this invention, much detail has been given to the basic structures involved and various alternatives have been taught for many of those structures involved. In all of the foregoing embodiments of the present invention, reference has been made to the mechanical impact arm assembly for providing the sensing and activating means by which the impact avoidance system of this invention operates.

Figure 9:
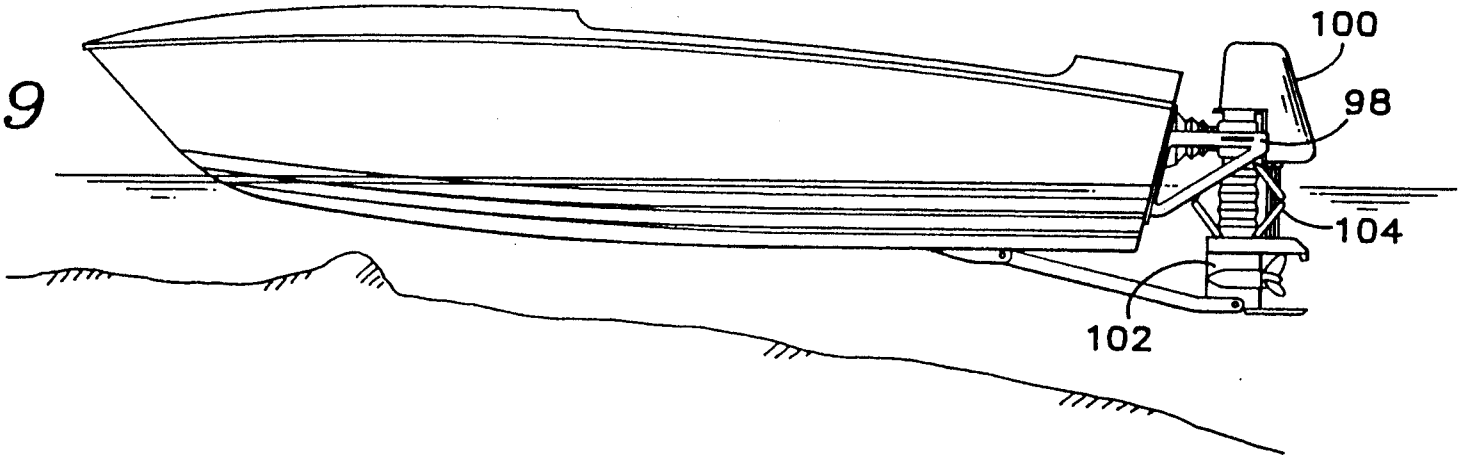
FIG. 9 is a side elevation of the marine drive unit impact avoidance system of this invention in connection with a specially configured inboard/outboard type drive unit, the drawing showing the drive unit in lowered, operational condition.
Figure 11:
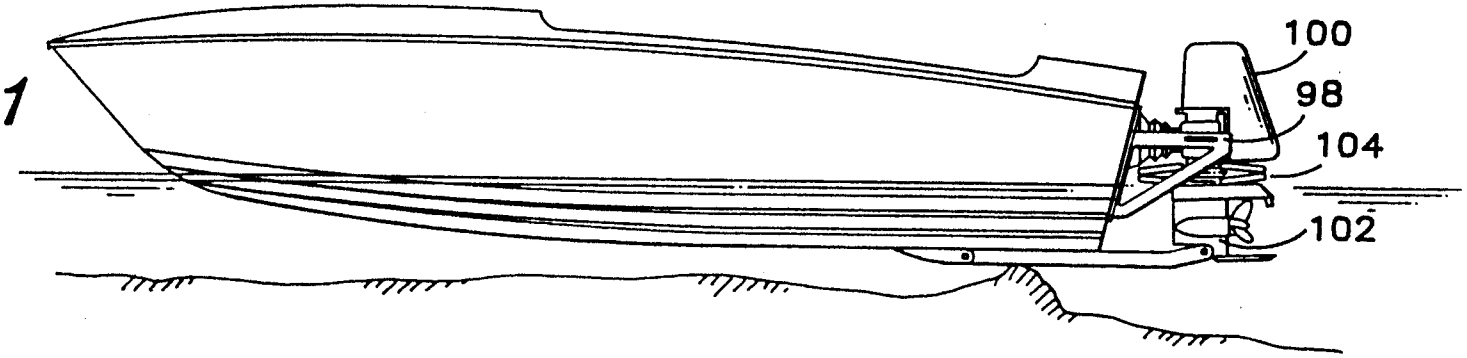
FIG. 11 is a side elevation of the system of FIG. 9, the drive unit shown in raised, protected condition upon contact of the impact arm with an underwater obstacle.
Figure 10:
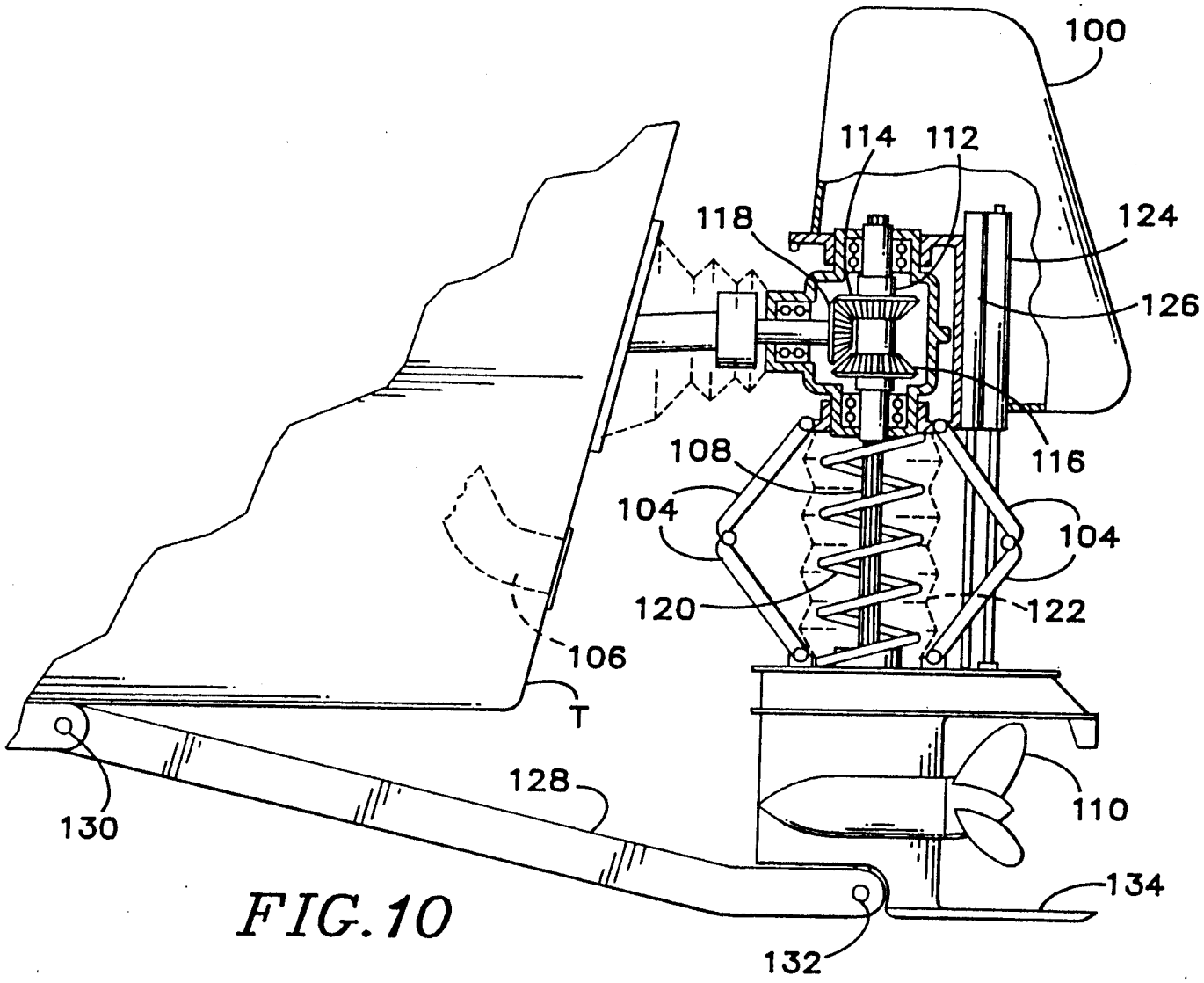
FIG. 10 is a fragmentary side elevation of the system of FIG. 9, parts being broken away to show internal detail.
Figure 13:
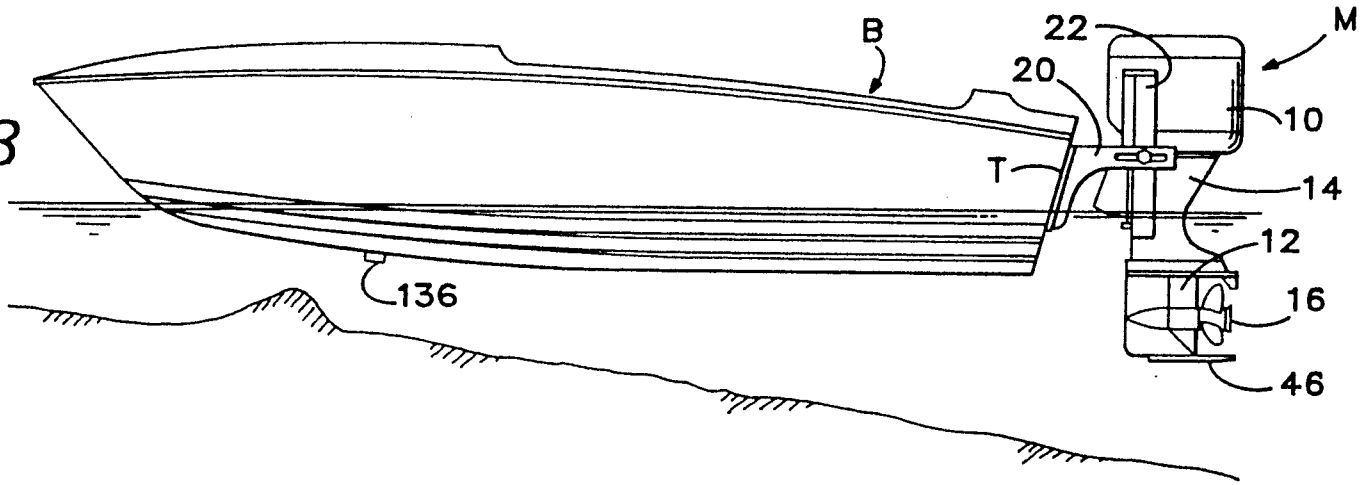
FIG. 13 is a side elevation of another embodiment of the marine drive unit impact avoidance system of this invention employing a transponder on the bottom of the boat connected to hydraulic lift cylinders engaging the marine drive unit to lift the lower unit vertically when an underwater obstacle is detected.
Figure 14:
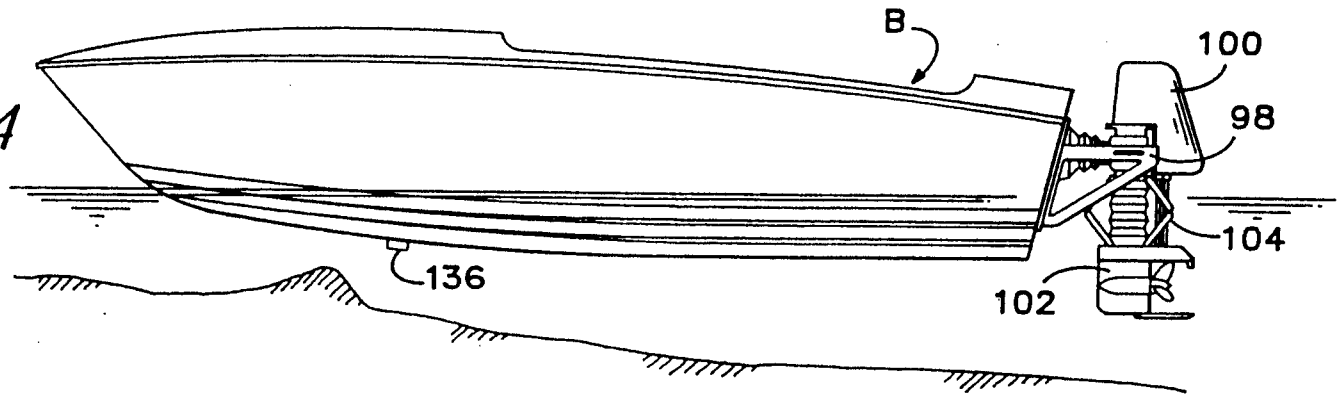
FIG. 14 is a side elevation similar to FIG. 13 but showing the transponder embodiment of this invention in connection with the stern drive configuration illustrated in FIGS. 9–12.

FIGS. 13 and 14 of the drawings are identical to FIGS. 1 and 9 of the drawings except that the mechanical impact arm structure has been replaced in the drawings by a conventional transponder 136 which is connected to a typical depth finder apparatus (not shown) in the boat. Many of these standard depth finder units include circuitry which triggers a signal, either visual or audio, to notify the operator of a boat of an underwater contact at a depth preselected by the operator. This sort of signalling circuit may alternatively be used, in the present invention, to activate the previously described hydraulic lift cylinders 36, 72, 90, and 126 which preferably, in these applications, are of a type designed to be capable of very fast operation. when the unit detects an underwater contact that would impact on the lower unit An override circuit may also be provided in order for the operator of the boat to operate the hydraulic cylinders at a slow rate to raise and lower the marine drive units as desired. Conventional engine cutout or cut back circuits may be provided, if desired, to prevent over-revving, and the system may include a timing or other suitable circuit arranged to automatically lower the drive unit after a preselected time interval or monitored depth has been achieved again.

Since the electronic system of this embodiment only replaces the mechanical sensing and activating functions of the impact arm assembly previously described, the remaining structures illustrated in FIGS. 13 and 14 are similar to those previously described in connection with FIGS. 1–12.

From the foregoing it will be apparent to those skilled in the art that various changes, other than those previously described, may be made in the size, shape, type, number and arrangement of parts described hereinbefore without departing from the spirit of this invention and the scope of the appended claims.

Having thus described my invention, I claim:

1. A marine drive unit impact avoidance system for a marine drive having an upper unit arranged to be supported behind the transom of a boat and a propeller-bearing lower unit extending from the upper unit for operation of the propeller behind and beneath the plane of the bottom hull of the boat, the impact avoidance system comprising:

a) drive unit mounting means on the transom configured to support the drive unit on the boat for vertical movement of the lower unit between a fully lowered, drive position and a raised position in which the lower unit is elevated on a substantially vertical line above its normal operating position, and b) longitudinally elongated impact arm means having a rear end configured for universal pivot attachment directly to the lower unit of a marine drive forward of its propeller, the impact arm means configured to extend forwardly and angularly upward therefrom for pivotal mount of its opposite, forward end to a boat below its water line forwardly of a marine drive unit supported behind the transom, whereby contact of the impact arm means with an underwater obstruction forces the arm to pivot on its forward mount on the boat and raise the lower unit vertically on the drive unit mounting means.

2. The marine drive unit impact avoidance system of claim 1 wherein said drive unit mounting means comprises a transom bracket configured for attachment to the transom of a boat, the transom bracket mounting a drive unit support member for movement of the lower unit of a drive unit carried on the support member on a substantially vertical line between a lowered, operative position in which the lower unit is disposed beneath the bottom hull of a boat and a raised position in which the lower unit is raised vertically to a point above the plane of the bottom of a boat.

3. The marine drive unit impact avoidance system of claim 2 wherein said drive unit support member on the transom bracket comprises a vertically movable carriage configured to receive the transom mount clamp structure of an outboard drive unit.

4. The marine drive unit impact avoidance system of claim 3 including shock absorber means engaging the transom bracket and the vertically movable carriage to dampen the free vertical movement of the carriage on the transom bracket.

5. The marine drive unit impact avoidance system of claim 3 including power lift means engaging the transom bracket and the vertically movable carriage to selectively raise and lower the drive unit mounting carriage between fully raised and fully lowered positions.

6. The marine drive unit impact avoidance system of claim 3 wherein said vertically movable carriage is mounted on the transom bracket for adjustment of the carriage horizontally toward and away from the transom for adjustment of the trim and propeller thrust angle of a drive unit supported on the carriage, and power trim means engages the transom bracket and the vertically movable carriage and is operable to selectively adjust the horizontal positioning of the carriage on the transom bracket.

7. The marine drive impact avoidance system of claim 2 wherein said drive unit support member comprises a pair of elongated, substantially horizontally extending arm members pivotally mounted on the transom bracket to extend rearwardly therefrom for vertical movement of the arm members relative to the transom bracket, the arm members configured to pivotally mount a drive unit adjacent their terminal ends, whereby contact of the angularly extending impact arm with an underwater obstacle forces the arm to pivot on its forward mount and raise the drive unit vertically on the pivotal mount of the supporting arm members on the transom bracket.

8. The marine drive unit impact avoidance system of claim 7 including shock absorber means engaging the transom bracket and the drive unit support arm members and arranged to dampen the free pivotal movement of the arm members relative to the transom bracket.

9. The marine drive unit impact avoidance system of claim 7 including power lift means engaging the transom bracket and the pivotal arm members to selectively pivot the arm members between raised and lowered positions in which the lower unit of the drive unit is disposed above and below the plane of the bottom hull respectively of a boat.

10. The marine drive unit impact avoidance system of claim 2 wherein said drive unit includes a vertically elongated, splined motor mounting shaft, and said transom bracket rotatably mounts a drive unit support member configured as a vertically disposed, hollow, splined sleeve arranged to receive said splined motor mounting shaft for free vertical movement of the latter therein, said rotatably mounted support member configured for engagement by the steering mechanism of a boat so that operation of the steering mechanism rotates the support member on its mount on the transom bracket to turn the drive unit received by the support member for steering the boat, and whereby contact of the angularly extending impact arm with an underwater obstacle forces the arm to pivot on its forward mount and raise the drive unit vertically on the mount of the splined shaft within the splined sleeve.

11. The marine drive unit impact avoidance system of claim 10 including shock absorber means engaging the transom bracket and the drive unit and arranged to dampen the free vertical movement of the latter.

12. The marine drive unit impact avoidance system of claim 10 including power lift means engaging the transom bracket and the drive unit to selectively raise and lower the drive unit vertically on its splined mount on the transom bracket between raised and lowered positions.

13. The marine drive unit impact avoidance system of claim 2 wherein the drive unit support member mounts the upper unit of a marine drive unit for vertical movement of the lower unit relative to the upper unit, shock absorber means interconnects the upper and lower units to dampen the vertical movement of the lower unit relative to the upper unit, whereby contact of the angularly extending impact arm with an underwater obstacle forces the arm to pivot on its forward mount on the boat and raise the lower unit vertically relative to the upper unit of the marine drive unit.

14. A marine drive unit impact avoidance system for a marine drive having an upper unit arranged to be supported behind the transom of a boat and a propeller-bearing lower unit extending from the upper unit for operation of the propeller behind and beneath the plane of the bottom hull of the boat, the impact avoidance system comprising:

a) drive unit mounting means on the transom configured to support the drive unit on the boat for vertical movement of the lower unit between the fully lowered, drive position and a raised position in which the lower unit is elevated on a substantially vertical line above its normal operating position, b) powered drive unit lifting means engaging the drive unit on a boat to move the lower unit of the drive unit vertically between a fully lowered, drive position and a raised position in which the lower unit is elevated on a substantially vertical line above its normal operating position, and c) electronic sensing means on the boat configured to detect the presence of an underwater obstacle prior to its impact with the lower unit of the drive unit, the sensing means communicating with said powered drive unit lifting means to activate the latter to raise the lower unit vertically prior to its impact with a detected underwater obstacle.

15. The marine drive unit impact avoidance system of claim 14 wherein said drive unit mounting means comprises a transom bracket configured for attachment to the transom of a boat, the transom bracket mounting a drive unit support member configured to receive the transom clamping mounting structure of an outboard drive unit.

16. The marine drive unit impact avoidance system of claim 14 wherein the drive unit mounting means on the transom comprises a drive unit support member mounting the upper unit of a marine drive unit for vertical movement of the lower unit relative to the upper unit, and the powered drive unit lifting means engages the drive unit to move the lower unit vertically relative to the upper unit.

* * * * *